US008763682B2

(12) United States Patent
Thomas et al.

(10) Patent No.: US 8,763,682 B2
(45) Date of Patent: Jul. 1, 2014

(54) CONDENSING HEAT EXCHANGER WITH HYDROPHILIC ANTIMICROBIAL COATING

(75) Inventors: Christopher M. Thomas, Madison, WI (US); Yonghui Ma, Johnson Creek, WI (US)

(73) Assignee: Orbital Technologies Corporation, Madison, WI (US)

( * ) Notice: Subject to any disclaimer, the term of this patent is extended or adjusted under 35 U.S.C. 154(b) by 1579 days.

(21) Appl. No.: 12/143,595

(22) Filed: Jun. 20, 2008

(65) Prior Publication Data

US 2009/0314469 A1 Dec. 24, 2009

(51) Int. Cl.
*F28F 19/04* (2006.01)
*F28F 19/06* (2006.01)
*F28F 13/18* (2006.01)

(52) U.S. Cl.
USPC ..... 165/133; 165/134.1

(58) Field of Classification Search
CPC ..... F28F 13/18; F28F 13/185; F28F 13/187; F28F 19/04; F28F 19/06
USPC ..... 165/133, 134.1
See application file for complete search history.

(56) References Cited

U.S. PATENT DOCUMENTS

| | | | | |
|---|---|---|---|---|
| 3,868,830 A | | 3/1975 | Fletcher et al. | |
| 5,203,402 A | * | 4/1993 | Nishishita et al. | 165/133 |
| 5,366,004 A | * | 11/1994 | Garner et al. | 165/133 |
| 5,562,949 A | | 10/1996 | Steele et al. | |
| 6,054,504 A | | 4/2000 | Dalla Riva Toma | |
| 6,418,743 B1 | | 7/2002 | Hauser et al. | |
| 6,506,636 B2 | | 1/2003 | Yamazaki et al. | |
| 6,525,882 B1 | | 2/2003 | Yamamoto et al. | |
| 6,539,731 B2 | | 4/2003 | Kesten et al. | |
| 6,740,590 B1 | | 5/2004 | Yano et al. | |
| 6,902,813 B2 | | 6/2005 | O'Shaughnessy et al. | |
| 6,921,579 B2 | | 7/2005 | O'Shaughnessy et al. | |

(Continued)

FOREIGN PATENT DOCUMENTS

| | | | | |
|---|---|---|---|---|
| JP | 62272099 A | * | 11/1987 | 165/133 |
| JP | 06123577 A | * | 5/1994 | 165/133 |

OTHER PUBLICATIONS

"Contamination-Free Manufacturing for Semiconductors and Other Precision Products", edited by Robert P. Donovan, p. 337 Published Mar. 14, 2001.

Ionpure printout from Ishizuka Glass Co. website, http://www.ishizuka.co.jp/ceramics/en/prodf/prod_01_01.htm printed Feb. 19, 2008.

(Continued)

*Primary Examiner* — Leonard R Leo
(74) *Attorney, Agent, or Firm* — Stiennon & Stiennon

(57) ABSTRACT

A multi-layer antimicrobial hydrophilic coating is applied to a substrate of anodized aluminum, although other materials may form the substrate. A silver layer is sputtered onto a thoroughly clean anodized surface of the aluminum to about 400 nm thickness. A layer of crosslinked, silicon-based macromolecular structure about 10 nm thickness overlies the silver layer, and the outermost surface of the layer of crosslinked, silicon-based macromolecular structure is hydroxide terminated to produce a hydrophilic surface with a water drop contact angle of less than 10°. The coated substrate may be one of multiple fins in a condensing heat exchanger for use in the microgravity of space, which has narrow channels defined between angled fins such that the surface tension of condensed water moves water by capillary flow to a central location where it is pumped to storage. The antimicrobial coating prevents obstruction of the capillary passages.

8 Claims, 4 Drawing Sheets

(56) References Cited

U.S. PATENT DOCUMENTS

| | | | | |
|---|---|---|---|---|
| 6,982,787 | B1 | 1/2006 | Wapner et al. | |
| 6,994,154 | B2 * | 2/2006 | Nagashima et al. | 165/134.1 |
| 7,011,145 | B2 | 3/2006 | Yeh et al. | |
| 7,041,178 | B2 | 5/2006 | Tong et al. | |
| 7,141,176 | B1 | 11/2006 | Smith et al. | |
| 7,192,844 | B2 | 3/2007 | Couillard et al. | |
| 7,198,699 | B2 | 4/2007 | Thomsen et al. | |
| 7,264,741 | B2 | 9/2007 | Hartig | |
| 7,309,527 | B2 | 12/2007 | O'Shaughnessy et al. | |
| 7,326,656 | B2 | 2/2008 | Brask et al. | |
| 2005/0154112 | A1 * | 7/2005 | Shigeru et al. | 524/430 |
| 2007/0199677 | A1 | 8/2007 | Hwang et al. | |
| 2007/0235170 | A1 * | 10/2007 | Zinck et al. | 165/133 |

OTHER PUBLICATIONS

"Contamination-Free Manufacturing for Semiconductors and Other Precision Products", edited by Robert P. Donovan, p. 337.

"Surface modification for hydrophilic property of stainless steel treated by atmospheric-pressure plasma jet", by M.C. Kim, D.K. Song, H.S. Shin, S.H. Baeg, G.S. Kim, J.H. Boo J.G. Han, S.H. Yang, Surface and Coatings Technology 171 (2003) pp. 312-316, © 2003 Elsevier Science B.V.

"Results of Plasma-Generated Hydrophilic and Antimicrobial Surfaces for Fluid Management Applications", by Yonghui Ma, Chris Thomas, Hongquan Jiang, Sorin Manolache, Mark Weislogel, Orbitech Technologies Corporation 2007-01-3139 copyright © 2007 SAE International.

* cited by examiner

CONDENSING HEAT EXCHANGER WITH HYDROPHILIC ANTIMICROBIAL COATING

STATEMENT AS TO RIGHTS TO INVENTIONS MADE UNDER FEDERALLY SPONSORED RESEARCH AND DEVELOPMENT

The U.S. Government has a paid-up license in this invention and the right in limited circumstances to require the patent owner to license others on reasonable terms as provided for by the terms of Agreement No. NNJ05JE75C awarded by NASA JSC.

CROSS REFERENCES TO RELATED APPLICATIONS

Not applicable

BACKGROUND OF THE INVENTION

The present invention relates to heat exchangers in general and heat exchangers for use in microgravity in particular and more generally to hydrophilic antimicrobial coatings for use in heat exchangers.

Hydrophilic surfaces are those with the property of attracting water so that a drop of water on the hydrophilic surface has a relatively low angle of contact with the hydrophilic surface. Contact angle is defined as a line tangent to the drop surface where it attaches to a surface. If the contact angle is greater than 90° the surface is said to be hydrophobic or non-wettable, if the contact angle is less than 90° the surface is characterized as wettable and hydrophilic. The interaction between liquid water and a solid surface is related to the phenomenon of surface tension where the attraction of the water molecules to each other draws the molecules of water at the surface inwardly, creating a molecular film of water molecules which acts like an elastic surface. Where the attraction between the liquid and the solid surface is greater than the surface tension forces i.e., greater than the attraction between the water molecules, water is drawn along the surface or into pores of the material according to a phenomenon known as capillary action. Controlling the interaction of a liquid, particularly water, with surfaces has many useful applications in addition to heat exchangers, for example in printing, and in the preventing of the formation of droplets on optical surfaces and windows.

A hydrophilic surface is advantageously used in a heat exchanger to cause water droplets which condense on the heat exchanger to spread out on the surface and flow towards capillary channels where the water can be collected without dependence on gravity.

In any situation where water is handled, especially water condensed from respired air, which necessarily is contaminated with minute amounts of organic material, the formation of biofilms can be a problem. A biofilm is an aggregation of microorganisms which excretes a protective and adhesive matrix, in the form of an extracellular matrix of polymeric substances which strongly attaches to the surface on which it forms. Biofilms are especially a problem in heat exchangers because they can reduce the effectiveness of heat transfer between the air and the cool surfaces of the heat exchanger and increase the pressure drop through the heat exchanger. Where the heat exchanger is used with air which is recirculated for breathing, the presence of biofilms poses a risk that pathogens from the biofilm may contaminate the breathable air.

Condensing heat exchangers for use in microgravity such as disclosed in U.S. Pat. No. 6,418,743 utilize coating forming hydrophilic surfaces with antimicrobial properties, such coatings assist in the transportation of water by capillary forces in microgravity. However, problems can arise with prior art hydrophilic coatings due to detachment of the coating from the condenser surfaces.

What is needed is a durable surface coating which can be applied to a variety of substrates and which imparts hydrophilicity to the surface while at the same time providing antimicrobial properties to control the growth of biofilms and pathogens. Further a condensing heat exchanger design which is adapted to be used with the improved hydrophilic and antimicrobial coating is needed.

SUMMARY OF THE INVENTION

The antimicrobial hydrophilic coating of this invention can be applied to a variety of surfaces including anodized aluminum, passivated stainless steel, graphite, aluminum oxide, polycarbonate resin sold under the trademark LEXAN®, and certain plastic surfaces including those formed of polyimide thermoplastic resins of amorphous polyetherimide sold as ULTEM® (Lexan® and Ultem® are registered trademarks of SABIC Innovative Plastics). The antimicrobial hydrophilic coating is applied over a passive surface such as anodized aluminum which is thoroughly cleaned. A layer of titanium or chromium is formed on the anodized surface for better bonding and to limit corrosion. On the titanium or chromium a layer of silver of approximately 400 nm thickness is formed. On top of the clean un-oxidized silver layer there is a layer of crosslinked, silicon-based macromolecular structure of approximately 10 nm thickness. The outermost surface of the layer of the silicon-based structure is hydroxide terminated to produce a hydrophilic surface with a water drop contact angle of, for example, less than 10° or less than can be measured.

The method of constructing the coating on aluminum involves forming a sealed hard-coat anodizing, followed by cleaning and drying the anodized surface. The layer of titanium is formed by sputtering onto the clean anodized surface of the aluminum, if chrome is used it may be electroplated. Silver is then sputtered onto the clean anodizing to a thickness of approximately 400 nm, the silver surface is again cleaned and a 10 nm layer of silicon-based structure is deposited from a plasma of silicon tetrachloride also known as tetrachlorosilane. The layer deposited from the tetrachlorosilane is then treated with boiling water which produces the hydroxide terminations on the silicon-based structure surface which imparts the hydrophilicity.

The hydrophilic antimicrobial coating of this invention utilizes techniques, particularly with respect to the silver sputtering, which are primarily line of sight deposition techniques and are therefore best used on flat plates, or plates with simple geometries. A heat exchanger which employs the hydrophilic antimicrobial coating of this invention utilizes a plurality of heat exchanging aluminum fins which are stacked and clamped between two cold plates. The cold plates are aligned radially along a plane extending through the axis of a cylindrical duct and hold the stacked and clamped portions of the heat exchanging fins along the axis of the cylindrical duct. The fins extend outwardly from the clamped portions along approximately radial planes. The spacing between fins is symmetric about the cold plates, and are somewhat more closely spaced as the angle they make with the cold plates approaches 90°. Capillary spaces are created in the vertexes formed in between adjacent fins. The variation in angles between the fins creates a capillary gradient that passively pumps condensate from the cold plates toward the center fin where it is pumped out of the fin assemblies. In addition where more narrow vertex angles are formed between adjacent fins, more capillary storage is facilitated. Passageways which are periodically spaced in the axial direction are formed through the fins to allow communication of the condensed water between adjacent vertex spaces i.e., space that provide for capillary storage. Capillary spaces formed by the vertex angles are also in communication with passageways formed in the stacked and clamped portions of the fins, which in turn communicate with water drains which extend externally to the duct. Water with little or no entrained air can be drawn from the capillary spaces with a simple low-volume liquid pump.

Air from which moisture is to be removed is caused to move by a fan through an air filter which removes particulate contaminants. After the air filter the air moves through a precooler which cools the air to a temperature which approaches the dew point, but which does not cause condensation to form. Because no condensation takes place in the precooler there is no need for hydrophilic or antimicrobial properties in the heat exchanger fins used in the precooler. The filtered and pre-cooled air is then caused to flow through the duct containing the condensing heat exchanger where cooling fluid circulating through the opposed cold plates draws heat from the heat exchanger fins causing their temperature to drop below the dew point of the air being dehumidified. Because of the high hydrophilicity on fin surfaces water condenses as a thin film which is constantly being drained to the capillary spaces and hence to the condensation drains.

It is a feature of the present invention to provide a durable hydrophilic surface with antimicrobial properties.

It is a further feature of the present invention to provide a more durable surface for a microgravity condensing heat exchanger.

It is yet another feature of the present invention to provide a coating which reduces the pressure drop through a condensing heat exchanger.

It is still another feature of the present invention to provide a condensing heat exchanger from which condensate water can be drawn with little or no entrained air.

It is still yet another feature of the present invention to provide a method of forming antimicrobial hydrophilic surfaces on a variety of substrate materials including both organic and inorganic materials.

Further objects, features and advantages of the invention will be apparent from the following detailed description when taken in conjunction with the accompanying drawings.

DESCRIPTION OF THE PREFERRED EMBODIMENTS

Figure 1:
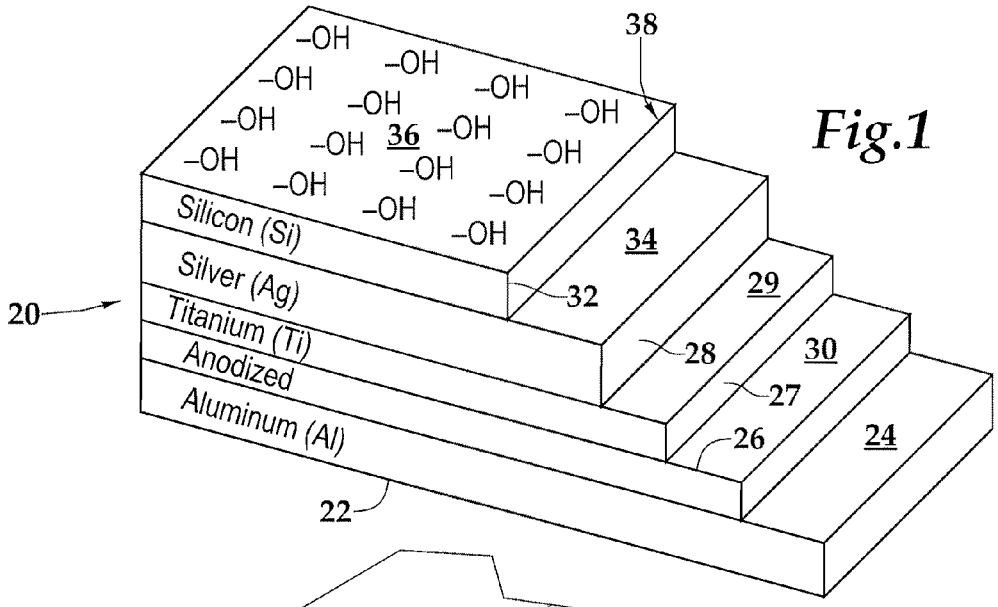
FIG. 1 is an schematic view of the substrate coated with the hydrophilic antimicrobial coating of this invention.

Referring more particularly to FIGS. 1-7 wherein like numbers refer to similar parts, a coating 20 is shown applied to an aluminum substrate 22. As shown in FIG. 1, the coating 20 is composed of five layers. The first layer 26 on the surface 24 of the aluminum substrate 22 is a layer of clear hard-coated anodizing of greater than about 25 μm thickness, which is sealed using Type 3 Class 1 process per MIL-A-8625.

A layer of titanium 27 of about 100 nm is formed on the anodized surface 30 for better bonding and to limit corrosion. Before application of the second layer 27, the surface 30 of the anodized layer 26 is thoroughly cleaned by placement in an ultrasonic bath with detergent for 30 minutes followed by rinsing with alcohol and acetone. The surface 30 is then vacuum dried at $10^{-4}$ Torr for four hours. Following the vacuum drying, the surface 30 is exposed to a hydrogen plasma of $10^{-2}$ Torr for 10 minutes which reduces oxides on the surface and produces volatile hydrogen compounds from surface impurities. The volatile hydrogen compounds so formed are pumped away during the cleaning step by a final drying step lasting at least three hours and with a final pressure of less than $10^{-5}$ Torr. The surface is then pre-cleaned with argon plasma at reduced power for one minute at $2\times10^{-2}$ Torr which effects a mechanical cleaning of organic contaminants from the surface 30. Following the pre-cleaning step, the second layer 27 of about 100 nm of titanium is deposited by titanium sputtering.

The third layer 28 is composed of 400 nm of silver bonded to the surface 29 of the Titanium layer 27. Following the formation of the sputtered titanium layer, the sputtering target is changed to one of sliver and the third layer 28 of 400 nm of silver is deposited by silver sputtering at a deposition rate of 30 Å or 3 nm per second. If necessary cleaning is conducted between the titanium layer and the silver layer if substrate is exposed to atmosphere during target switch. However, if both layers are deposited one after the other in the same vacuum environment no cleaning may be necessary.

Before application of the fourth layer 32 composed of a 10 nm layer of crosslinked, silicon-based macromolecular structure, the surface 34 of the silver third layer is cleaned with hydrogen plasma for 10 seconds at $10^{-2}$ Torr. The layer of silicon-based structure 32 is deposited from a tetrachlorosilane ($SiCl_4$) plasma at 0.11 Torr.

Finally a fifth layer 36 is formed of hydroxyl groups (—OH) as a result of converting the top layer of the silicon-based macromolecular structure, by treating the surface 38 of the silicon-based layer 32 with purified water heated to boiling, i.e. greater than about 90° C. to about 100° C., and agitated by stirring.

Silver or titanium sputtering is a so-called physical vapor deposition process in which typically several magnetrons are used, to ensure even distribution, especially in complex geometries, 2- or 3-fold rotation systems may be used. The magnetrons generate electrons of sufficient energy so that when they collide with a neutral atom a positive ion is produced which is attracted towards a silver or titanium target surface and knocks off silver or titanium atoms which are deposited on the substrate.

Hydrogen, argon and tetrachlorosilane plasmas are utilized as so-called cold plasmas. A plasma is an ionized gas. Cold plasma refers to a gas in which only a small fraction (for example 1%) of the gas molecules are ionized, and is typically used at low pressures. Cold plasma processes are useful for surface modification as the energy is not generally sufficient to penetrate deeply into materials or to cause melting of plastics and other relatively low temperature materials.

The first layer 26 consisting of the anodized aluminum surface is specific to use of an aluminum substrate where it is necessary to prevent galvanic corrosion between the aluminum and the silver layer. For other base materials a similar anodized or passivated surface is required if the base layer is metal and is not closely spaced in the galvanic series from sliver. For stainless steel the passivated surface is very close to silver and no further coating is needed prior to the deposit of the silver layer, although it is possible to strip off and re-apply the passivated surface. For plastics such as Ultem® material, a family of polyimide thermoplastic resins, of type amorphous polyetherimide, no pre-coating of the surface is necessary. In all cases cleaning steps prior to the application of the silver coating are useful or essential for the close bonding between the silver and the substrate or base material.

Figure 2:
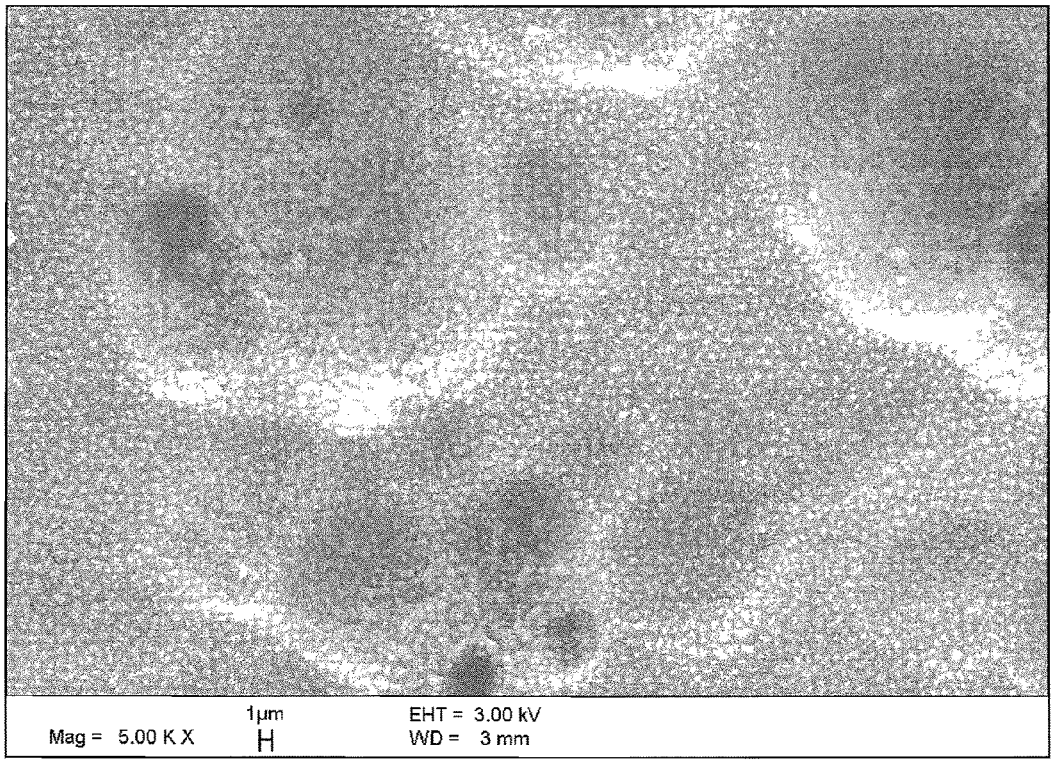
FIG. 2 is a scanning electron microscope image of a coating of FIG. 1.
Figure 3:
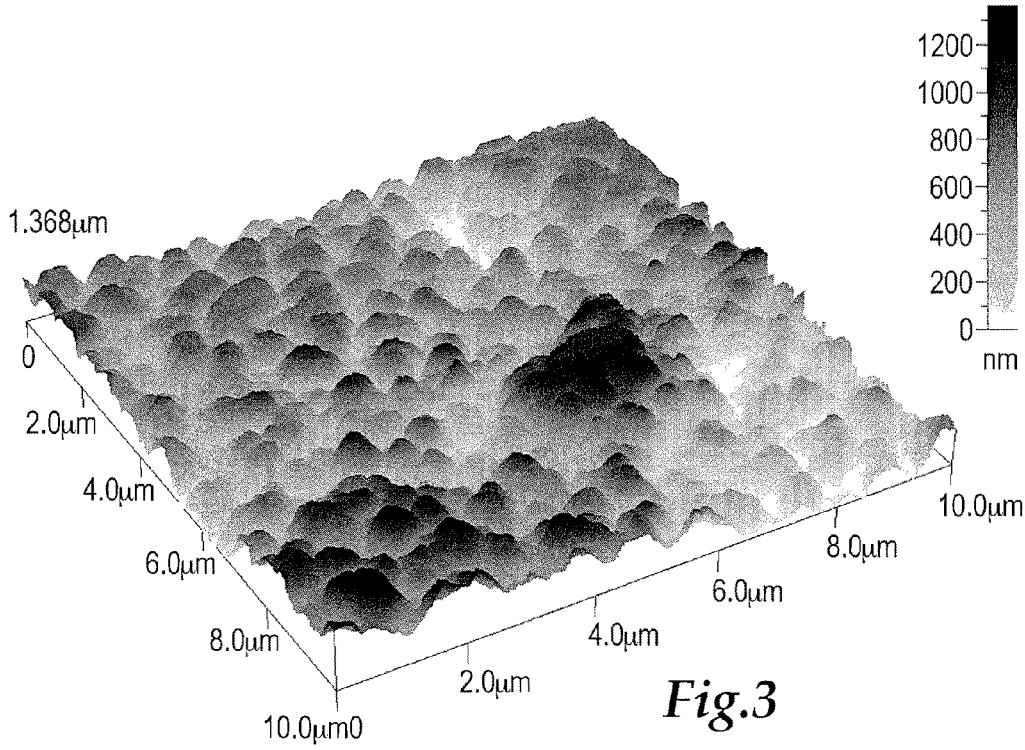
FIG. 3 is an atomic force microscope image of a coating of FIG. 1.

The coating 20 is in essence a nano structure which has been characterized by the process steps used to create the coating. Without limitation by way of explanation only FIG. 2 is a Scanning Electron Microscope image (SEM) of a surface covered by the coating 20 without the intermediary titanium layer 27, with a magnification of 5000×. Light-colored granules, in a darker matrix in FIG. 2 appear to correspond to peaks in the topography as indicated by the atomic force microscope image of the coating 20 without the titanium layer 27 as shown in FIG. 3. The chemical compositions of different areas observed under SEM can be determined by EDS technique (Energy Dispersive Spectrometer), which is part of the SEM. However, the penetration depth of EDS is 5-10 microns whereas the coating 20 is less than 1 micron thick. So although EDS cannot provide an accurate measurement of the surface composition due to the signals coming from the bulk of the substrate instead of the surface coating, this technique does show that the granules or peaks are extremely rich in silver, whereas the valleys contain more aluminum. For a truly surface analysis X-ray Photoelectron Spectroscopy (XPS) can be used. However, XPS data cannot be correlated directly to SEM images, and therefore one cannot use XPS data to help determine the chemical composition of a particular area observed under SEM. Moreover, XPS takes its reading from a surface area of ~3 $mm^2$, which is much larger than the area measured by EDS, which means XPS provides averaged reading. An XPS spectrum obtained from a fully treated aluminum sample without the titanium layer 27, showed the coating treatment 20 is thick enough to completely isolate the substrate material from XPS. In addition, silver (about 3-6%) and silicon were found on the sample, which means the coating process has successfully generated silver and Si-based functionalities on the sample surface.

Figure 4:
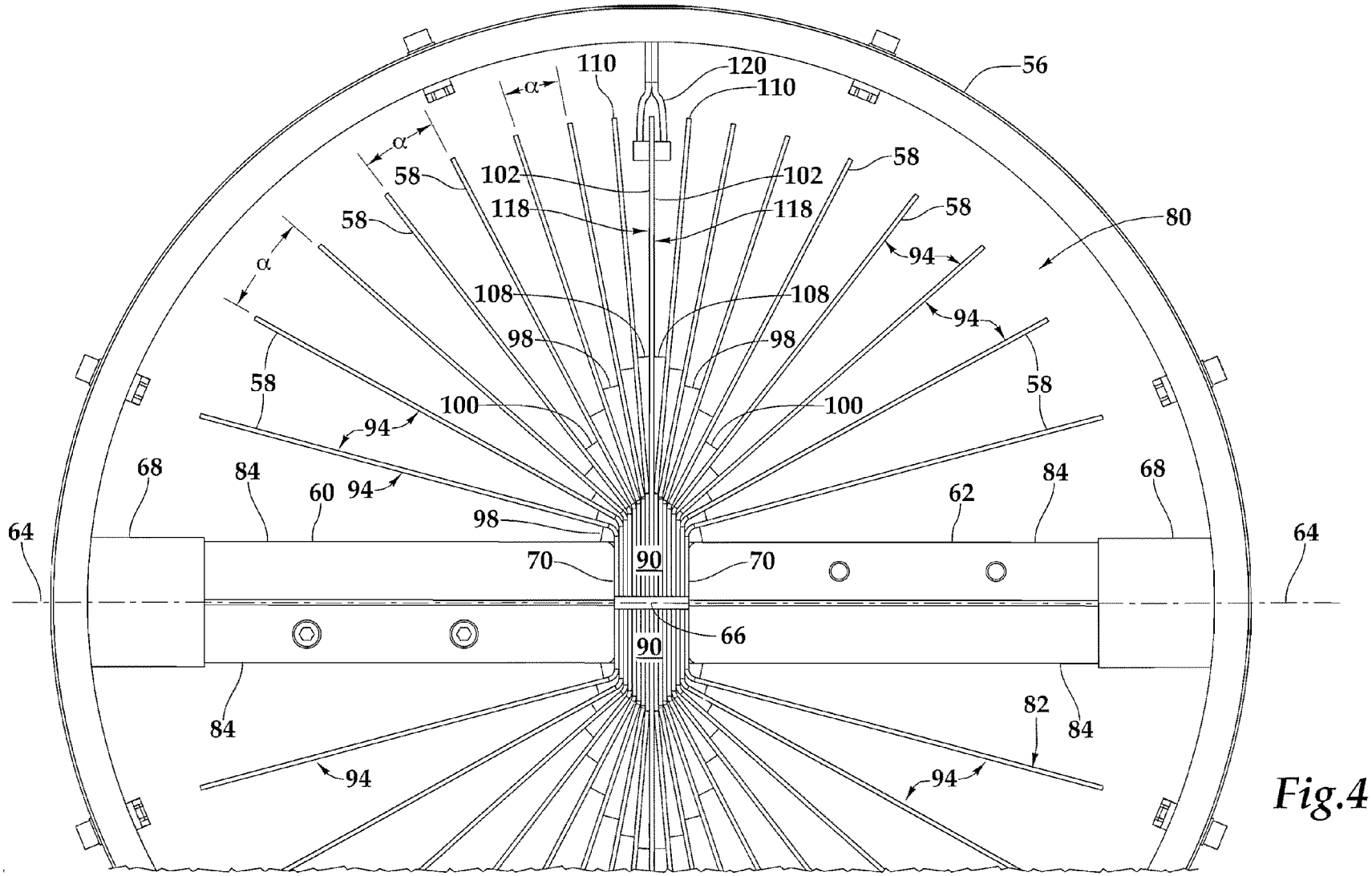
FIG. 4 is a front elevational view of the condensing heat exchanger of this invention.
Figure 5:
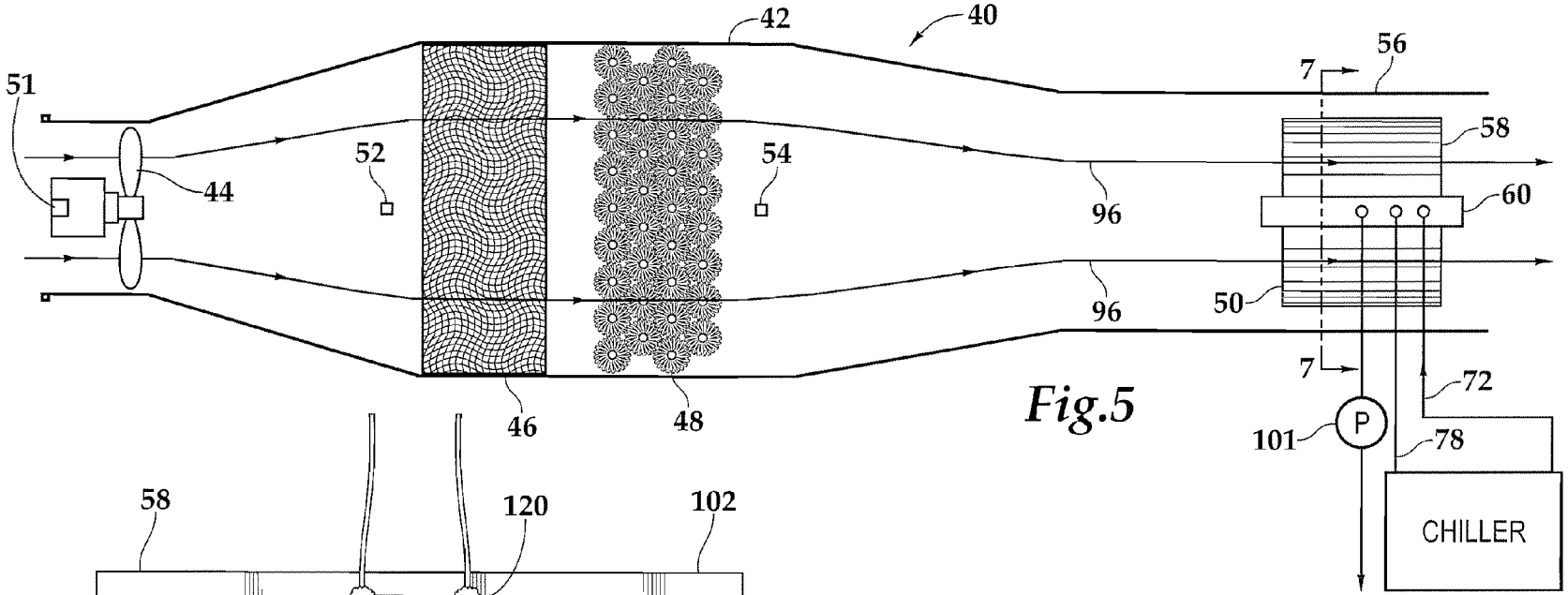
FIG. 5 is a side elevational view of an air duct containing a fan, a filter, a precooler and the condensing heat exchanger of FIG. 4.

The coating 20 allows for the construction of a heat exchanger assembly 40 particularly suitable for use in the microgravity of space as shown in FIGS. 4-7. Referring to FIG. 5, the heat exchanger assembly 40 is comprised of a duct 42 in which is arranged a fan 44 followed by an air filter 46, a precooler 48, and a condensing heat exchanger 50. The fan 44 draws air from a room or cabin and supplies it to the duct 42 where it flows through the filter 46 to remove particulates and possibly organic volatiles. Following the filter, the air is cooled by the precooler 48 and then passed through the condensing heat exchanger 50. A rotation sensor 51 is mounted to the fan 44 to monitor and allow control of the fan speed. An air-sensing temperature sensor 52 is mounted between the fan 44 and the filter 46, and a sensor 54 which combines an air temperature sensor and relative humidity sensor is mounted after the precooler and before the condensing heat exchanger 50. Suitable controls are arranged so that the airflow supplied by the fan 44, the cooling load of the precooler 48, and the cooling load of the condensing heat exchanger 50 may be controlled so that no condensation takes place in the precooler but the air passing through the duct 42 is brought to a near saturation condition before entering the condensing heat exchanger 50. In this way the cooling capacity of the condensing heat exchanger is used to condense water by cooling below the dew point in the heat exchanger 50. The duct 42 is uninsulated so that a small amount of heat moves into the duct to prevent the condensation of water on the interior surfaces of the duct, particularly in that portion of the duct 56 which surrounds the condensing heat exchanger 50. The duct 42 is arranged with various cross-sections connected by sections arranged to accommodate the various components, fan 44, filter 46, precooler 48, and heat exchanger 50, and to create an even air flow with minimum flow resistance.

The condensing heat exchanger 50 mounted within the duct section 56 is shown in FIG. 4. The heat exchanger 50 has two sets of thermally conducting fins 58 which are clamped between a first cold plate 60 and a second cold plate 62. The cold plates 60, 62 are arranged along a plane 64 which passes through the axis 66 of the duct section 56. The cold plates 60, 62 are thermally isolated from the duct by thermally insulating foam blocks 68. The cold plates 60, 62 have clamping surfaces 70 which are clamped in thermal conducting engagement so as to hold the plurality of fins 58 therebetween. The clamping force is developed by bolts (not shown) which pass through the cold plates 60, 62 and holes 122 in the fins 58 as shown with respect to one fin in FIG. 6. Each cold plate 60, 62 is made of aluminum and has an inlet 72, as shown in FIG. 5, for coolant which connects to a first passageway 74, shown in FIG. 7, which runs axially adjacent to a clamping surface 70. The first passageway 74 forms one side of a U-shaped flow passage wherein the second side forms a second wider passageway 76 more distal from the clamping surface 70, the second passageway leading to a coolant outlet 78, shown in FIG. 5. The coolant may be a 50/50 mixture of propylene glycol and water although other coolants such as water can be used. Propylene glycol because of its low toxicity is preferred as an anti-freeze where a leak could result in human exposure. Propylene glycol is sufficiently non-toxic to be used as a food additive.

Figure 7:
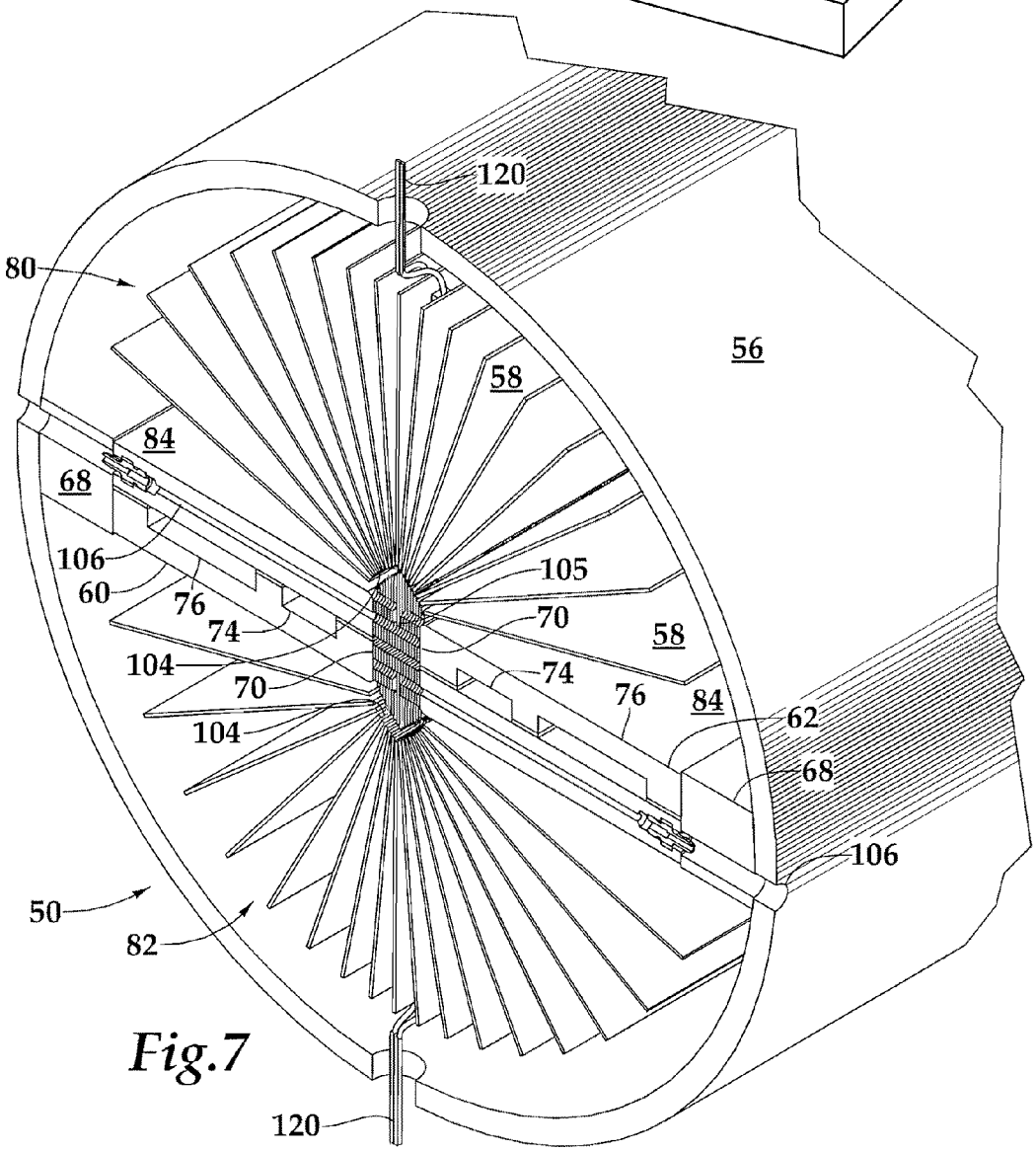
FIG. 7 is an isometric cross sectional view of the condensing heat exchanger of FIG. 5 taken along Line 7-7.

To minimize weight, the thermally conducting fins 58 are preferably constructed of aluminum, which in the example shown in FIGS. 4, and 7 have a thickness of 0.032 inches, and a condensing surface which extends in the radial direction 3 inches (7.6 cm) and in the axial direction 6 inches (15.2 cm). The condensing heat exchanger 50 is positioned in the duct section 56 with an inside diameter of 8.25 inches (21 cm). The fins 58 are divided into an upper group 80 of 17 fins, and a lower group 82 of 17 fins. Each group 80, 82 of fins forms a fin assembly, arranged like the open pages of a book where for the upper group 80 the inside cover of the book is represented by the upwardly facing surfaces 84 of the cold plates 60, 62. The lower group of fins 82 is similarly arranged and positioned as a mirror image of the upper group 80 like two books with their spines abutting across the axis 66 of the duct 56.

The heat exchanger assembly 40 employing the condensing heat exchanger 50 as dimensioned above is arranged to pass 3.8 L per minute of a 50/50 mixture of propylene glycol and water which has a specific density of 1.046 and a specific heat of 0.85 kcal/(kg° C.) so the heat capacity of the cooling fluid is 3.8 L/minute×1.046 kg/L×0.85 kcal/(kg° C.)×(12° C.−4° C.)=27 kcal/minute. Air with a dew point of 12° C. has a water vapor content of 9 grams of water per kg; air with a dew point of 4° C. has a water vapor content of 5 grams of water per kg. To cool 1 kg of 12° C. saturated air to saturated 4° C. requires cooling 1 kg of air (12° C.−4° C.)=80°×(specific heat of air 0.24 kcal/kg° C.) or 1.92 kcal and condensing (9 grams−5 grams)=0.004 kg of water×540 kcal/kg=2.16 kcal, so total cooling is 4.08 Kcal. Thus if completely efficient, 3.8 L per minute flow of coolant could theoretically condition air such that the dew point out is minimized, resulting in a water condensation rate based on (27 kcal/minute)/(4.08 kcal/kg) or 6.6 kg/minute of air, producing 6.6 kg/minute×0.004 kg/kg of water or 0.026 kg/minute or 26 gm/minute or 26 ml/minute. Air massing 6.6 kg at 4° C. has a volume of 6.6 kg×0.785 $m^3$/kg or 5.2 $m^3$. The duct 56 has an area of some what less than 0.034 $m^2$ and so that velocity in the duct 56 is somewhat greater than (5.2 $m^3$/minute air flow rate)/(0.034 m2)=153 m/minute or about 2.5 m/s (8 ft/s). To obtain complete thermodynamic efficiency, however, a heat exchanger of infinite length is required.

Figure 6:
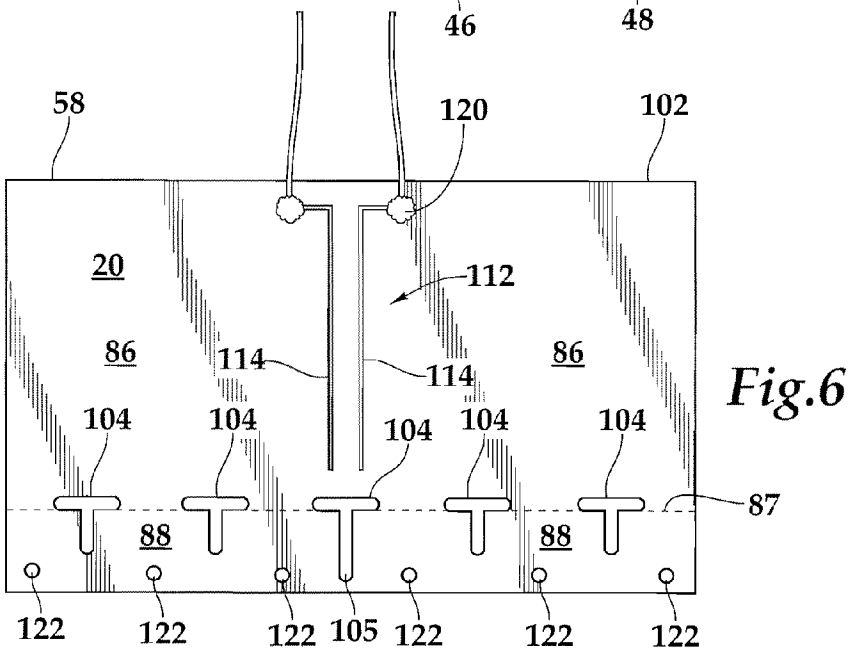
FIG. 6 is a plan view of a heat exchanger fin of FIG. 4 showing a water depth sensor formed thereon.

Before treatment with the coating 20, the fins 58 are prebent (except the central fin 102) as shown in FIG. 4 so that each fin has a condensing portion 86 and a base portion 88. For illustrative purposes a bend line 87 is illustrated in FIG. 6, although for the fin 102 illustrated no bending is actually necessary. The entire surface of both sides of each fin 58 is treated with the coating 20, although on parts of the base portions 88 where the hydrophilic and antimicrobial surface are not necessary, and on parts of the central fin 102 in connection with forming a water depth sensor 112, deposition of the coating 20 is or can be prevented by masking. The facing surfaces 84 of the cold plates 60, 62 are also treated with the coating 20. The base portions 88 of the fins 58 of each group 80, or 82 are arranged to form a stack 90 like the binding of a book. Thermal grease may be placed between the base portions 88 of the fins 58 to increase thermal conductivity between the fins and the cold plates 60, 62.

The best thermal path between the coolant circulating in the cold plates 60, 62 and the condensing surfaces will be between the facing surfaces 84 of the cold plates 60, 62, and the fins 58 which are more closely spaced from the cold plates. Surfaces 94 of the fins 58 and the facing surfaces 84 of the cold plates 60, 62 when exposed to a flow of air passing through the duct, shown by arrows 96 in FIG. 5, will cool the air passing over the surfaces resulting in the condensation of water 98 on the surfaces, which because of the hydrophilic coating will form as thin coatings of water which are removed by capillary forces within the capillary or apex spaces 100 formed where the fins 58 and the cold plates 60, 62 come together as in the binding of a book. The fins 58 of each group of fins 80, 82 are arranged symmetrically with 8 fins on either side of a central fin 102 which extends at a 90° angle from the plane 64 of the cold plates 60, 62. Each group of eight fins is not arranged with evenly angular spacing, rather the fins closer to the central fin 102 make a smaller angle α with adjacent fins, and the fins closer to the facing surfaces 84 of the cold plates 60, 62 have larger angles α with adjacent fins, so that starting with the facing surfaces of the cold plates, angles α progressively diminish towards the central fin 102. For example, as illustrated in FIG. 4, the angular spacing between the cold plate surface 84 and the first fin is approximately 15°, the next spacing between the fins is 14° and so on forming spacings of 12.5°, 11°, 10°, 9°, 7.5°, 6°, and 5° until the central fin 102 is reached. This angular spacing has two benefits, first, more air, shown by arrows 96 in FIG. 5, passes between surfaces which are better cooled by the circulating coolant and thus better able to condense water, and second the more narrow spacing between the fins 58 more closely spaced with respect to the central fin 102 achieves more effective capillary spaces 100. T-shaped holes 104 in the fins 58 as shown in FIG. 6 provide cross communication between the capillary spaces 100 formed between fins 58, such that the more narrow capillary spaces between the fins draw and store water 108 from the cold plate surfaces 84 and the fins 58 with wider angular spacing as shown in FIG. 4. This arrangement means that the fins 58 which are less effective for condensation are more effective for water storage, and the fins that are more effective for condensation have less of their surface covered by a thick layer of insulating water 108.

An important advantage of the condensing heat exchanger 50 over prior art heat exchangers is the ability to better separate condensate without entraining air, reducing or eliminating the need for a gas liquid separation stage before storage of the condensate. This advantage is achieved by monitoring the amount of water stored in the capillary spaces 100 and removing the water by a simple positive displacement low-volume liquid pump 101 which draws water through a drain 106 connected to the capillary spaces 100 by only the bases of the center T-shaped holes 104. The capillary spaces 100 formed by the vertex angles are in communication with passageways 105 formed in the stacked and clamped portions of the fins, which in turn communicate with water drains 106 which extend out side the duct 56. Water with little or no entrained air can be drawn from the capillary spaces with the pump 101. The pump is controlled so that a minimum amount of water remains in the capillary spaces such that air is not drawn through the capillary spaces 100 in to the passageways 105 and water drains 106 as shown in FIG. 7. Capillary spaces 108 formed by adjacent fins 110 on either side of the central fin 102 form water condensate storage spaces with considerable height of water as illustrated in FIG. 4.

As shown in FIG. 6, water depth sensors 112 are affixed to the central fin, which because of the water condensate storage spaces 108 formed on either side of the central fin make the central fin 102 an ideal location for positioning the water depth sensors 112 which measure the amount of water stored in the capillary spaces 108. For redundancy, two sensors 112 are formed on either side of the central fin 102. The sensors 112 have capacitance measuring traces 114 which are formed as two parallel conducting traces which extend the direction of increasing water depth in the storage spaces 108. The capacitance traces 114 output a signal which is proportionate to water depth. Resistance sensors (not shown) which may be placed in the condensate drain lines or storage tank provide a measure of the condensate's conductivity which can be used to normalize the capacitance output of the traces 114 by compensating for the changes in condensate resistance. The sensors 112 can be self-calibrated in the microgravity environment of space by shutting down the fan 44 and using the positive displacement condensate drain pumps 101 shown in FIG. 5 to can add or subtract a calibrated amount of condensate to the storage spaces 100. Once calibrated, the sensors 112 can be adjusted in real time to compensate for changing resistance values of the condensate based on real-time measurements of condensate conductivity.

The sensors 112 are formed on the surfaces 118 on either side of the central fin 102 such that the sensors do not interfere with the capillary storage of water. The design is compatible with the surface treatment process 20 and the water storage behavior of the fin assemblies 80, 82. Silver is utilized for the electrode material to enhance microbial control near the sen sor. Silver traces are formed over the anodized layer 26 with silver traces leading to an outer edge of the central fin 102 where the sensor traces are connected to sensor connectors 120, as shown in FIG. 4. In the fabrication of the central fin 102 the silver layer 28 is not applied in an area about the sensor traces 114, by masking this area during silver deposition to prevent shorting the traces, however the final layer of silicon-based structure 32 which forms the hydrophilic layer 36 can be deposited over the silver leads in the insulating spaces for uniform hydrophilicity of the fin surfaces 118 and the sensor 112. No polymers or other foreign materials should be added to the fin surfaces as they might reduce the quality of the surface coating 20. The sensor 112 and the traces 114 do not result in edges which act as pinning points for water. Such pinning points would be detrimental to the water level measurements, because the measurement would not be universal to the entire fin assemblies 80, 82.

To initiate operation of the heat exchanger 40, the pump 101 is operated in reverse to supply water to the capillary spaces 100 of the condensing heat exchanger 50. Following priming in this way the fan 44, the pre-cooler 48 and the condensing heat exchanger 50 are turned on and water is condensed on fins 58. As condensate is built up in the capillary spaces 100 as indicated by the sensor 112, condensate is withdrawn by the pump 101 in a controlled manner based on the output of the sensor to prevent aspirating air with the draining condensate.

It should be understood with the aluminum substrate 22 the layer of sputtered titanium may not be present, or a layer of electroplated or otherwise deposited chromium may be used between the anodized layer 30 and the silver layer 28. A nickel layer could also be used, for example electroless nickel of about 1200-1900 nm can be used between the anodized layer 30 and the silver layer 28. The titanium, chromium or nickel layer may be applied directly on an aluminum oxide layer or on unoxidized aluminum. Chromium and nickel have the advantage that they can be plated as opposed to the required sputtering of titanium. The silver layer can also be electroplated or chemically plated on the underlying substrate. In the case of electroplating or chemically plating the layers will in general be thicker, for example when plating sliver over nickel a target silver plated layer of 400 nm may have an actual thickness ranging from about 400 nm to 1000 nm. In some cases an electroplated or chemically plated layer can be even two to three orders of magnitude thicker than sputtered layers.

It should be understood that vacuum is generally understood herein as a pressure ranging from less than standard atmospheric pressure to as close as theoretically possible to the complete absence of gas. The term is usefully divided up into ranges with a medium vacuum constituting a pressure of 25 to $1\times10^{-3}$ Torr, and a high vacuum constituting a pressure of $1\times10^{-3}$ to $1\times10^{-9}$ Torr, such that the drying steps used to form the coating 20 are performed at high vacuum, whereas the plasma treatment steps and the sputtering step are performed at medium vacuum.

It should be understood that the layer deposited from the tetrachlorosilane ($SiCl_4$) plasma is a layer of crosslinked, silicon-based macromolecular structure, which is also referred to herein as a layer of silicon-based structure. This term serves to preserve the full breadth of the nano-structure disclosed.

It is understood that the invention is not limited to the particular construction and arrangement of parts herein illustrated and described, but embraces all such modified forms thereof as come within the scope of the following claims.

We claim:

1. A heat exchanger comprising:

a source of circulation cooling fluid;

a water condensing element in contact with the source of circulation cooling fluid, the water condensing element having a water condensing surface;

a hydrophilic antimicrobial coating on the water condensing surface, the hydrophilic antimicrobial coating comprising:

a first layer of silver formed on the water condensing surface;

a second layer of crosslinked, silicon-based macromolecular structure of a thickness of about 10 nm which does not prevent the antimicrobial activity of the layer of silver, formed on the first layer and bonded directly to the silver forming the first layer; and a hydroxide-terminated surface formed on the second layer and providing a hydrophilic surface with an equilibrium water contact angle of less than 10°.

2. The heat exchanger of claim 1 wherein the water condensing element has a substrate of aluminum with a sealed anodized surface, to which the first layer of silver is bonded.

3. The heat exchanger of claim 1 wherein the water condensing element has a substrate of aluminum on which a layer of titanium is formed on which the first layer of silver is formed.

4. The heat exchanger of claim 1 wherein the water condensing element has a substrate of aluminum with a sealed anodized surface on which a layer of titanium is formed on which the first layer of silver is formed.

5. The heat exchanger of claim 1 wherein the water condensing element has a substrate of aluminum with a sealed anodized surface on which a layer of nickel is formed on which the first layer of silver is formed.

6. The heat exchanger of claim 1 wherein the water condensing element has a substrate of aluminum on which a layer of chromium is formed to which the first layer of silver is bonded.

7. A heat exchanger comprising;

a water condensing element in contact with a cooling fluid, the water condensing element having a water condensing surface;

a plurality of capillary spaces, in condensate receiving relation to the condensing surfaces;

a hydrophilic antimicrobial coating on the water condensing surface, the hydrophilic antimicrobial coating comprising:

a layer of silver formed on the water condensing surface which exhibits antimicrobial activity;

a layer of crosslinked, silicon-based macromolecular structure deposited from a cold plasma of a thickness of about 10 nm which does not prevent the antimicrobial activity of the layer of silver; and a hydroxide-terminated surface formed on the layer of crosslinked, silicon-based macromolecular structure of about 10 nm in thickness and providing a hydrophilic surface with an equilibrium water contact angle of less than 10°.

8. A heat exchanger comprising:

a source of circulation cooling fluid;

a water condensing element in contact with the source of circulation cooling fluid, the water condensing element having a water condensing surface;

a hydrophilic antimicrobial coating on the water condensing surface, the hydrophilic antimicrobial coating comprising:

a layer of silver of an effective thickness, bonded to the water condensing surface;

a layer of crosslinked, silicon-based macromolecular structure bonded to and overlying the silver layer forming a silicon to silver bond, the layer of crosslinked, silicon-based macromolecular structure of a thickness which does not prevent an effective antimicrobial activity of the layer of silver; and a hydroxide-terminated surface formed by converting a top layer of the layer of crosslinked, silicon-based macromolecular structure of about 10 nm in thickness, said hydroxide-terminated surface providing a hydrophilic surface with an equilibrium water contact angle of less than 10°.

* * * * *